US005582544A

United States Patent [19]

Ely

[11] Patent Number: 5,582,544

[45] Date of Patent: Dec. 10, 1996

[54] ADJUSTABLE AIR DISTRIBUTION APPARATUS

[76] Inventor: Robert S. Ely, 2269 Old Frankfort Pike, Lexington, Ky. 40510

[21] Appl. No.: 372,738

[22] Filed: Jan. 13, 1995

[51] Int. Cl.[6] ..... F24F 13/06

[52] U.S. Cl. ..... 454/306; 454/322

[58] Field of Search ..... 454/284, 286, 454/305, 306, 322

[56] References Cited

U.S. PATENT DOCUMENTS

| | | | |
|---|---|---|---|
| 791,397 | 5/1905 | Asbury | 454/306 |
| 1,032,912 | 7/1912 | Killpatrick | 454/306 |
| 2,197,614 | 4/1940 | Hall et al. | 454/306 X |
| 2,209,054 | 7/1940 | Doud et al. . | |
| 3,808,698 | 5/1974 | Peters . | |
| 3,919,929 | 11/1975 | Harmon | 454/306 X |
| 4,522,255 | 6/1985 | Baker . | |
| 4,712,313 | 12/1987 | Gettleman . | |

FOREIGN PATENT DOCUMENTS

| | | | |
|---|---|---|---|
| 179850 | 7/1989 | Japan | 454/306 |
| 377634 | 7/1932 | United Kingdom | 454/306 |

OTHER PUBLICATIONS

Factair®"Terminal Outlets for Worker Control of Ducted", Preconditioned Air; United McGill Corporation; Product Brocure; May 1985.

*Primary Examiner*—Harold Joyce
*Attorney, Agent, or Firm*—King and Schickli

[57] ABSTRACT

An apparatus is provided for establishing an air flow pathway between a stationary feed duct of an air handling system and a desired spot in a work environment. The apparatus includes an air passage conduit in communication with the feed duct including a flexible intermediate section and an adjustable rotary coupling so as to allow full directional control.

14 Claims, 2 Drawing Sheets

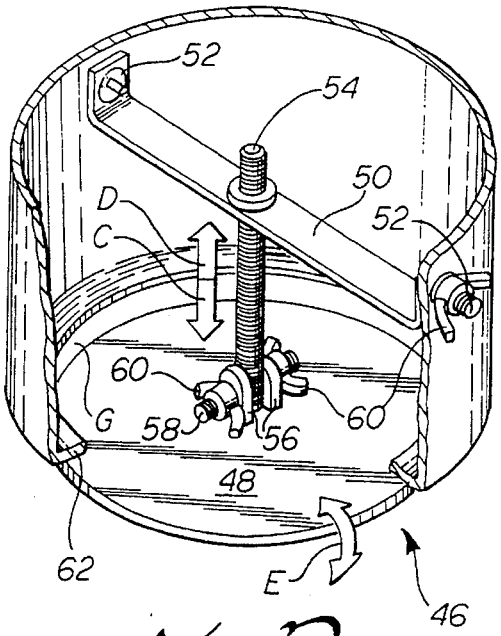
Fig. 2
Fig. 4
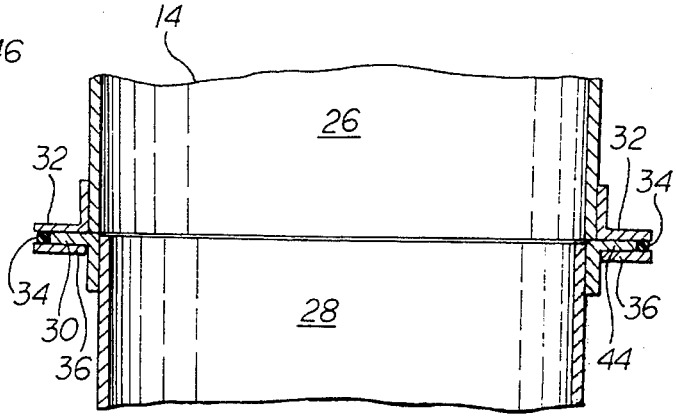
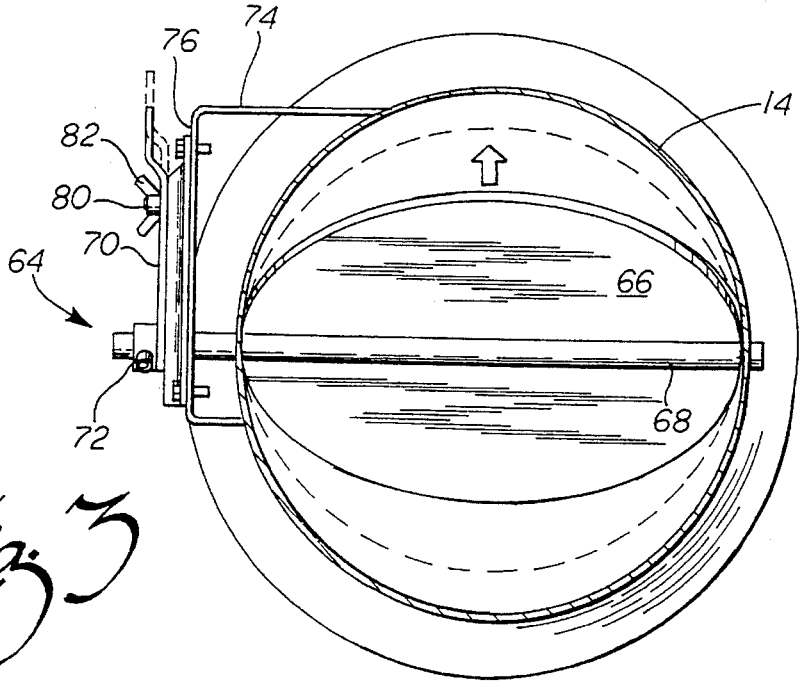
Fig. 3

ADJUSTABLE AIR DISTRIBUTION APPARATUS

TECHNICAL FIELD

The present invention relates generally to the field of environmental control and, more particularly, an improved apparatus for establishing an air flow pathway between a duct of an air handling system and a desired spot in a work environment.

BACKGROUND OF THE INVENTION

Large factory areas are often open to the ambient environment and/or contain large machinery and equipment such as furnaces that produce localized high heat outputs. In these adverse factory conditions, heating or cooling for worker comfort is generally effected by delivering a source of air at a predetermined temperature through a series of main ducts generally positioned overhead so as to be out of the way of factory workers. Drops are provided in fluid communication with the main ducts at spaced locations about the factory typically corresponding to the work stations of the individual workers.

The work stations are generally located adjacent to industrial machinery under the control of the individual. Some machinery produces greater heat than others and, accordingly, the localized ambient temperature at any work station may vary significantly from another. Further, some individuals are more active at their work stations and, therefore, are inclined to feel warmer than those who are not. Of course, some individuals may dress more warmly than others. When these factors are all considered in combination with the fact that individual preferences vary, it should be appreciated that each individual at a work station needs to have the ability to adjust both the volume and direction of air flow being delivered through the main duct and drop to the individual's work station.

This need for customized control has long been recognized in the art. One earlier attempt to provide an adjustable air distribution apparatus to meet this need is disclosed in U.S. Pat. No. 3,919,929 to Harman. The air distribution apparatus disclosed in Harman includes an upper or inlet duct for connection to the drop, a lower or outlet duct for delivering air to work station and a ball joint swivel for interconnecting the inlet and outlet ducts. While effective in providing some control to allow an individual at a work station to adjust and control the conditioned air flow from the air handling system, the Harman apparatus is not without disadvantages.

More specifically, while providing some directional control, the Harman device still fails to provide the actual directional control desired by most individuals. Firstly, directional control is limited by the use of the ball joint swivel. Specifically, engagement of the outlet duct with the upper and outer interfitting spherical portion of the ball joint swivel connection serves to effectively limit the angle of adjustment to only approximately 22° in any direction from the center line axis of the flow path through the inlet duct.

Secondly, a factory environment around industrial machinery is generally oily, greasy and dirty. Accordingly, dust, oil and other debris tends to collect on the exposed surfaces of the swivel connection. When certain subsequent adjustments are made this oil, grease and dirt is actually directed under force into the ball joint connection, initially impairing and in a short time finally completely freezing its movement and operation. Thus, all directional adjustability is quickly lost.

Thirdly, directional control is limited by the controls themselves. Specifically, a damper allows individual control of the flow volume and a separate flow control valve allows individual adjustment of that volume between axial delivery and radial delivery from the exhaust duct. It should therefore be appreciated that true directional control to allow an individual to, for example, deliver air around a tight corner to a specific point is not provided.

While on initial review this deficiency in directional control may not appear to be an important issue, further evaluation proves otherwise. Specifically, it must be appreciated that many plants operate several shifts and, accordingly, more than one individual will be employed at each work station at different times. As pointed out above, different individuals have different preferences regarding air flow and, accordingly, any limits to adjustability that prevent an individual from working comfortably lead directly to lower productivity and employee complaints.

Further, it should be appreciated that manufacturing equipment in factories is often updated and/or modified and/or replaced in order to maintain a competitive edge. The new machinery typically has different dimensions and, accordingly, the position of the work station is often shifted at least to a slight degree relative to the stationary main duct and drop. It is a very expensive process to move the main duct and drop to accommodate the repositioning of the work station. If, however, greater adjustability could be provided for the directional control of the air from the drop, it may be possible to accommodate the repositioning of the work station through a simple adjustment of the air distribution outlet device. Accordingly, the significant additional expense of moving the main duct and drop may be avoided.

SUMMARY OF THE INVENTION

Accordingly, it is a primary object of the present invention to provide an apparatus for establishing an air flow pathway between a duct, such as a stationary feed duct, of an air handling system and a desired spot in the work environment overcoming the above-described limitations and disadvantages of the prior art.

Another object of the present invention is to provide an apparatus for establishing an air flow pathway that may be utilized to direct conditioned air from a stationary duct to a work station and/or to draw air from a specific direction of a work environment into a stationary duct of a vacuum system.

Yet another object of the present invention is to provide an apparatus of relatively simple and inexpensive construction for establishing an airflow pathway between a stationary feed duct and a work environment providing both complete volume and directional control to allow an operator to tailor the air flow for the utmost operator comfort.

Yet another object of the present invention is to provide an air distribution apparatus that may be easily and reliably manipulated over a long service life to provide a significantly wider range of directional control than previously available with prior art designs.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for establishing an airflow pathway between a stationary feed duct of an air handling system and a desired spot in the work environment. The apparatus includes an air passage conduit in fluid communication with the feed duct. The air passage conduit includes a proximal end section, a distal end section and an intermediate adjustment section.

The proximal end section is mounted to the feed duct by means of sheet metal screws or any other appropriate fastener of a type known in the art. The proximal end section also defines a first flow path about and along a first centerline axis. Similarly, the distal end section defines a second flow path about a second, centerline axis.

The intermediate adjustment section interconnects the proximal and distal end sections. Preferably, the intermediate adjustment section is a flexible tube that is selectively positionable to provide the second path defined by the distal end section at substantially any selected angle in any direction relative to the first path axis. This allows at least four times the angular adjustability in any direction when compared with conventional prior art air distribution devices incorporating a ball joint swivel arrangement.

The apparatus of the present invention also includes a rotary coupling on the proximal end section. This rotary coupling provides a full 360° of rotation about the first flow path axis whereby the relative position of the intermediate adjustment section and distal section may be moved. This allows the workers to direct the delivery of conditioned air from the air flow conduit in the manner desired to meet an individual's preference. Alternatively, when the air passage conduit is connected to a vacuum system, air may be drawn from the work environment from any selected position and direction.

In accordance with still another aspect of the present invention, it should be appreciated that the apparatus may also include at least one, and preferably a pair of opposed stabilizer arms. Each stabilizer arm is pivotally connected at a first end to the proximal end section and at a second end to the distal end section of the air passage conduit. Thus, the opposed stabilizer arms straddle the intermediate adjustment section and thereby serve to stabilize and hold the apparatus and particularly the intermediate flexible tube section in any desired position. Wing nuts or other appropriate means may be tightened to secure and lock the apparatus in a desired position. As a result, the apparatus of the present invention not only establishes but maintains the airflow pathway between the air handling system and the desired spot over time even when subjected to vibrations that may be communicated to the apparatus from the main and feed ducts of the air handling system or other sources.

The apparatus may also include a damper means for controlling the volume of air flowing through the air passage conduit. Preferably the damper means comprises a plate having a face substantially corresponding in size and shape to the interior passageway formed by the proximal end section. This plate is pivotally mounted in this section and controlled by manipulation of a control handle to open or close the passageway.

In addition, a directional control means in the form of at least one adjustable vane or flap may be mounted to the end of the distal end section. The flap allows fine tuning of the air flow direction from the end of the apparatus adjacent the operator. Specifically, the individual may choose radial distribution or direct the air to any desired location from the axial end of the distal end section. This directional control means also provides volume control. This significantly enhances user convenience and control.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing:

FIG. 2 is a fragmentary, partially sectional view showing the directional control flap on the axial end of the distal end section of the apparatus;

FIG. 3 is a sectional view along line 3–3 of FIG. 1 showing the damper means for controlling the volume of air delivered through the apparatus; and FIG. 4 is a detailed sectional view showing the rotary coupling allowing 360° relative rotary movement.

Figure 1:
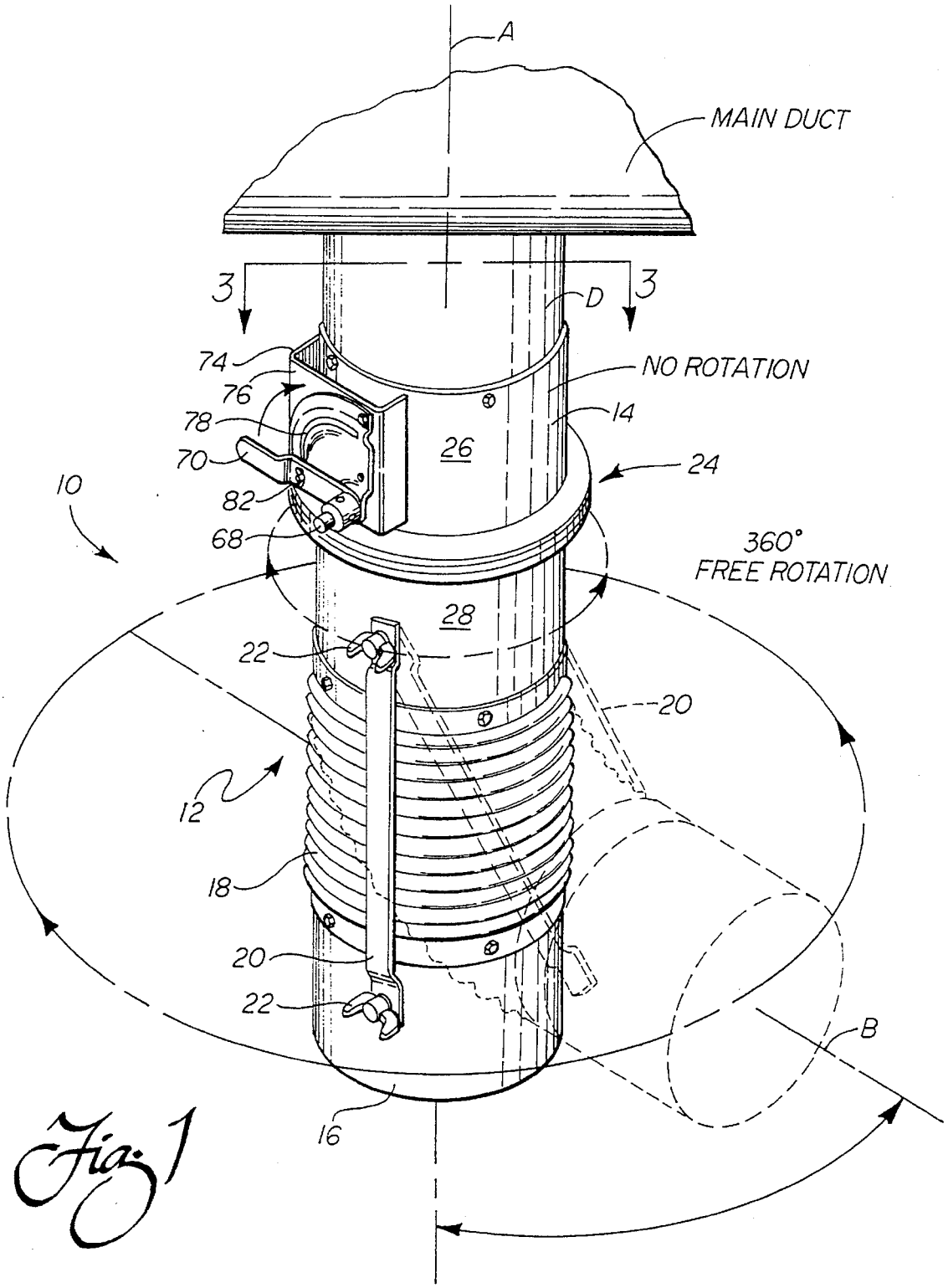
FIG. 1 is a perspective view of the apparatus of the present invention for establishing an air flow pathway.

Reference will now be made in detail to the present preferred embodiment of the invention, an example of which is illustrated in the accompanying drawing.

DETAILED DESCRIPTION OF THE INVENTION

Reference is now made to FIG. 1 generally showing the apparatus 10 of the present invention for establishing an air flow pathway between a stationary feed duct or drop D of an air handling system and a desired spot in a work environment. More particularly, the apparatus 10 includes an air passage conduit, generally, designated by reference numeral 12, that is provided so as to be in fluid communication with the duct D.

More particularly, the air passage conduit 12 includes a proximal end section 14 for mounting to the feed duct D and defining a first centerline flow path about a first axis A. The air passage conduit 12 also includes a distal end section 16 for defining a second centerline flow path about a second axis B and an intermediate adjustment section 18 in the form of, for example, a flexible tube of polyethylene or other appropriate material for interconnecting the proximal and distal end sections 14, 16. More particularly, as will become better appreciated as to the description hereof proceeds, the intermediate adjustment section 18 is positionable to provide the second flow path along axis B defined by the distal end section at substantially any hemispherically defined selected angle (e.g. 0°–180°) in any direction relative to the first flow path defined by the axis A. Of course, an apparatus 10 of the type described is subjected to significant vibrations through the feed duct D of the air handling system and from other sources such as the heavy machinery located in the factory.

Accordingly, one main concern is the stability of the apparatus 10 to maintain its adjusted position as selected by the individual. Toward this end, the apparatus 10 is equipped with a pair of opposed stabilizer arms 20. Each stabilizer arm 20 is pivotally connected at a first end to the proximal end section 14 (in particular the segment 28 described below) and at a second end to the distal end section 16. Preferably the connection is made by bolt and cooperating wing nut 22 or other appropriate fastening means.

As should be appreciated, the stabilizer arms 20 straddle the intermediate adjustment section 18 on opposing sides thereby stabilizing and securely holding the adjustment section in position against vibrations that would otherwise have a tendency to cause undesirable movement. In extreme cases, the wing nuts 22 may be tightened down to provide a secure engagement for effectively locking the intermediate section 18 against movement.

It should further be appreciated, that the provision of the stabilizer arms 20 in no way limits the adjustability of the apparatus 10. More specifically, the proximal end section 14 includes a rotary coupling, generally designated by reference numeral 24. More specifically, it should be appreciated that the proximal end section 14 comprises aligned first and second tubular segments 26, 28, respectively. The proximal end of the first tubular segment 26 is connected to the feed duct D by sheet metal screws 29 or other appropriate fastening device utilized in the art. The distal end of the first tubular segment 26 includes a circumferencial channel 30 (see also FIG. 4). The circumferencial channel 30 is formed by three components welded together. The first is a mounting ring 32 having a substantially L-shaped cross section so as to provide a mounting rim for securing to the distal end of the first tubular section 26 by means of welding or screw fasteners. The other two elements are annular rings 34, 36. The intermediate annular ring 34 positioned between the mounting ring 32 and outer annular ring 36 has a narrower face than the mounting ring and outer ring. Thus, when the three rings 32, 34, 36 are welded together, the circumferencial channel 30 is formed and defined by the inner edge of the intermediate annular ring, and juxtaposed faces of the mounting ring and outer annular ring respectively.

The second tubular segment 28 includes a radially extending flange 44 at a first or proximal end thereof that is received in the channel 30. Sufficient clearance is provided between the flange 44 and the inner edge and faces of the rings 32, 34 and 36 respectively so as to allow for free 360° rotation of the second tubular section 28 relative to the first tubular section 26. Advantageously, as the relatively moving surfaces of the rotary coupling 24 are all enclosed, they are protected from contamination with the dust, dirt, oil and grease of the work environment. Accordingly, the present rotary coupling 24 provides full function over a long and carefree service life.

The distal end of the second tubular section 28 is connected to the intermediate adjustment section 18 and, accordingly, by radially adjusting the position of the second tubular segment 28 it is possible to position the stabilizer arms 20 so as to allow the bending of the flexible intermediate adjustment section 18 in any desired direction at an angle of, for example, up to as much as 180° relative to the axis A of the first flow path. In fact, if desired it is even possible to simply offset the second flow path defined by the distal end section 16 of the apparatus 10 relative to the first flow path defined by the proximal end section 14. Thus, it should be appreciated that significant flexibility and versatility in adjustment is provided.

Additionally, the apparatus 10 may optionally include a further means 46 for controlling the direction of air flow from the distal end section 16 of the air passage conduit 12 (see FIG. 2). More particularly, a vane or flap 48 is mounted to the axial end of the distal end section 16 by means of a bracket 50, screws 52, threaded rod 54, mounting lugs 56, threaded pin 58 and wing nuts 60. More specifically, the bracket 50 is secured to the end section 16 by means of cooperating screws 52 and wing nuts 60. The threaded rod 54 is provided in threaded engagement with the bracket 50. A threaded pin 58 extends through aligned apertures in the mounting lugs 56 on flap 48 and an aperture in the threaded rod 54. Wing nuts 60 secure the flap 48 to the threaded pin 58 by means of the lugs 56.

The controller 46 may be adjusted to provide "fine tuning" to the directional control of the air flow from the axial end of the distal end section 16 of the apparatus 10. For example, it is possible to provide a radially directed flow of air by rotating the flap 48 counterclockwise so as to extend the flap away from the end of end section 16 (note action arrow C). This functions to increase the gap G between the flap and the end flange 62 to provide an increased radial air flow. Alternatively, the flap 48 may be rotated clockwise to close the gap G (note action arrow D) and reduce or even cut off the radial air flow. Accordingly, additional volume control is also provided.

As another alternative, the flap 48 may be tilted relative to the threaded rod 54 and end section 16 (note action arrow E) to provide directional control for the axial distribution of air from the end section 16. Advantageously, it should be appreciated that either radial or axial distribution of the air flow is selectively possible. Further, the flap 48 is easily adjusted and readily reachable by the individual worker at his/her work station. As a result, the air flow may be conveniently altered as desired without presenting any substantial distraction to the worker from his/her duties.

In addition, the apparatus 10 may also incorporate a further optional feature in the form of a damper arrangement, generally designated by reference numeral 64 for controlling the volume of air flow through the air passage conduit 12 (see FIG. 3). More particularly, the damper 64 is preferably formed by a plate 66 having a shape and contour or outline substantially corresponding to the internal passageway of the proximal end section 14. As should be appreciated, the plate 66 may be welded to an axle 68 engaging in apertures at opposing points in the wall of the proximal end section 14. A control handle 70 is attached to the axle 68 by a set screw 72 or other appropriate fastener. If desired, a mounting bracket 74 with backing plate 76 may also be provided. As shown, the backing plate 76 may include an arcuate slot 78. A screw 80 passes through this arcuate slot 78 and an aligned aperture in the handle 70. A wing nut 82 holds the screw 80 in position. By tightening the wing nut 82 on the screw 80, it is possible to provide positive pressure to secure the plate 66 in any desired position.

More specifically, by selectively manipulating the control handle 70, it is possible to set the angle of the plate 66 within the proximal end section 14 anywhere between a fully closed position wherein the flow is substantially blocked by the plate and a fully opened position wherein the flow proceeds substantially unimpeded through the air passage conduit 12. Thus, air volume control is easily obtained.

In summary, numerous benefits result from employing the concepts of the present invention. An apparatus 10 is provided for establishing an air flow pathway between a stationary feed duct and a desired spot in the work environment that is equally applicable for air handling systems designed to provide conditioned air to the work environment or vacuum systems designed to withdraw air from the work environment. The apparatus 10 provides far greater flexibility and versatility allowing an individual worker to control the air flow through the air passage conduit 12 to an extent and in a manner previously unknown in the art. Further, this flexibility of adjustment is achieved by means of a system that provides reliable operation over an extended service life even in harsh operating conditions in the presence of airborne dust, dirt, oil and grease. Additionally, the apparatus 10 may be easily and positively secured in the position selected by the worker and it does not shift over time as a result of vibrations and other extraneous environmental inputs. Accordingly, a worker is not annoyed by a need to continuously readjust the apparatus to provide the desired air flow.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. An apparatus for establishing an air flow pathway between a duct of an air handling system and a desired spot in a work environment, comprising:

an air passage conduit in fluid communication with the duct, said air passage conduit including (a) a proximal end section for mounting to the duct and defining a first flow path about a first axis, (b) a distal end section for defining a second flow path about a second axis and (c) an intermediate adjustment section for interconnecting said proximal and distal end sections, said intermediate adjustment section being flexible to provide the second flow path defined by said distal end section at a selected angle in any direction relative to the first flow path; and said apparatus being characterized by said proximal end section including an adjustable rotary coupling providing relative rotation for said intermediate adjustment section and distal end section about the first axis.

2. The apparatus set forth in claim 1, wherein said proximal end section includes a first tubular segment having a circumferential channel at one end and a second tubular segment having a radially extending flange at a first end, said flange being freely received in said channel so as to form said rotary coupling and allow for an effective 360° rotary movement between said segments.

3. The apparatus set forth in claim 2, wherein said intermediate section of said air passage defining means is a flexible pipe.

4. The apparatus set forth in claim 3, further including at least one stabilizer arm pivotally connected at a first end to said proximal end section and at a second end to said distal end section whereby said intermediate flexible pipe section may be stabilized and held in a desired position.

5. The apparatus set forth in claim 4, including means for locking said apparatus in an adjusted position.

6. The apparatus set forth in claim 3, further including a pair of opposed stabilizer arms, each stabilizer arm being pivotally connected at a first end to said proximal end section and at a second end to said distal end section whereby said intermediate flexible pipe section may be stabilized and held in a desired position.

7. The apparatus set forth in claim 6, including means for locking said apparatus in an adjusted position.

8. The apparatus set forth in claim 1, further including a damper means for controlling the volume of air flowing through said air passage conduit.

9. The apparatus set forth in claim 8, wherein said damper means is carried on said proximal end section.

10. The apparatus set forth in claim 8, further including directional control means for controlling the direction of air flow from said distal end section of said air passage conduit.

11. The apparatus set forth in claim 10, wherein said directional control means is at least one vane mounted to said distal end section across the second flow path.

12. An apparatus for establishing an air flow pathway between a duct of an air handling system and a desired spot in a work environment, comprising:

an air passage conduit in fluid communication with the duct, said air passage conduit including (a) a proximal end section for mounting to the duct and defining a first flow path about a first axis, (b) a distal end section for defining a second flow path about a second axis and (c) an intermediate adjustment section for interconnecting said proximal and distal end sections, said intermediate adjustment section being flexible to provide the second path defined by said distal end section at a selected angle in any direction relative to the first path; and at least one stabilizer arm pivotally connected at a first end to said proximal end section and at a second end to said distal end section whereby said intermediate adjustment section may be stabilized and held in a desired position.

13. An apparatus for establishing an air flow pathway between a duct of an air handling system and a desired spot in a work environment, comprising:

an air passage conduit in fluid communication with the duct, said air passage conduit including (a) a proximal end section for mounting to the duct and defining a first flow path about a first axis, (b) a distal end section for defining a second flow path about a second axis and (c) an intermediate adjustment section for interconnecting said proximal and distal end sections, said intermediate adjustment section being flexible to provide the second path defined by said distal end section at a selected angle in any direction relative to the first path; and a pair of opposed stabilizer arms, each stabilizer arm being pivotally connected at a first end to said proximal end section and at a second end to said distal end section whereby said intermediate adjustment section may be stabilized and held in a desired position.

14. An apparatus for establishing an air flow pathway between a duct of an air handling system and a desired spot in a work environment, comprising:

an air passage conduit in fluid communication with the duct, said air passage conduit including (a) a proximal end section for mounting to the duct and defining a first flow path about a first axis, (b) a distal end section for defining a second flow path about a second axis and (c) an intermediate adjustment section for interconnecting said proximal and distal end sections, said intermediate adjustment section being flexible to provide the second flow path defined by said distal end section at a selected angle in any hemispherically defined direction relative to the first flow path; and said apparatus being characterized by said proximal end section including an adjustable rotary coupling providing relative rotation for said intermediate adjustment section and distal end section about the first axis.

* * * * *